US005165675A

United States Patent [19]

Kanaya

[11] Patent Number: 5,165,675

[45] Date of Patent: Nov. 24, 1992

[54] CONTROL MEANS FOR GUIDE MEMBERS IN AN INTERMEDIATE TRAY IN A DUPLEX COPIER

[75] Inventor: Koichi Kanaya, Yokohama, Japan

[73] Assignee: Ricoh Company, Ltd., Tokyo, Japan

[21] Appl. No.: 849,835

[22] Filed: Mar. 12, 1992

Related U.S. Application Data

[63] Continuation of Ser. No. 552,457, Jul. 16, 1990, abandoned.

[30] Foreign Application Priority Data

Jul. 24, 1989 [JP] Japan ..... 1-188952

[51] Int. Cl.[5] ..... B65H 5/22

[52] U.S. Cl. ..... 271/3.1; 271/171; 271/233; 271/241; 355/24; 355/319

[58] Field of Search ..... 355/26, 319, 24, 318; 271/3.1, 220, 221, 241, 223, 226, 227, 228, 240, 246, 254, 171

[56] References Cited

U.S. PATENT DOCUMENTS

| | | | |
|---|---|---|---|
| 4,466,733 | 8/1984 | Pels | 355/319 |
| 4,607,834 | 8/1986 | Dastin | 271/223 X |
| 4,657,239 | 4/1987 | Ikesue et al. | 271/240 X |
| 4,949,134 | 8/1990 | Iwaki et al. | 355/319 X |
| 4,978,111 | 12/1990 | Kosugi et al. | 271/3.1 |
| 5,110,113 | 5/1992 | Kanaya | 271/241 |

FOREIGN PATENT DOCUMENTS

| | | | |
|---|---|---|---|
| 0237050 | 9/1987 | European Pat. Off. . | |
| 2804492 | 8/1978 | Fed. Rep. of Germany . | |
| 0162760 | 12/1981 | Japan | 355/23 |
| 1-104567 | 4/1989 | Japan . | |
| 2141109 | 12/1984 | United Kingdom . | |
| 2227734 | 8/1990 | United Kingdom . | |

*Primary Examiner*—A. T. Grimley
*Assistant Examiner*—J. E. Barlow, Jr.
*Attorney, Agent, or Firm*—Oblon, Spivak, McClelland, Maier & Neustadt

[57] ABSTRACT

A control device for a copier of the type loaded with a recyclic document feeder (RDF) and operable in a two-sided copy mode for producing two-sided copies by sequentially stacking one-sided paper sheets and refeeding them for transferring images on the other side thereof. In the two-sided copy mode, side fences provided on an intermediate tray are moved toward and away from each other in matching relation to the paper size. Even when the entry of a paper sheet in and the refeed of a paper sheet from the intermediate tray occur alternately, paper sheets entered the tray can be accurately controlled in position with no regard to the paper size.

13 Claims, 12 Drawing Sheets

SUB-COPY
S1
TOW-SIDED COPY MODE ?
NO
RET
YES
S2
SET NUMBER OF COPIES N
S3
HOME SIDE FENCES AND BACK FENCE
S4
SET MODE 1
S5
FEED DOCUMENTS ONE BY ONE, COPY ONLY ODD PAGES, AND STACK RESULTING COPIES ON INTERMEDIATE TRAY
S6
END OF 1ST FOUND ?
NO
YES

| Fig.10A |
| --- |
| Fig.10B |

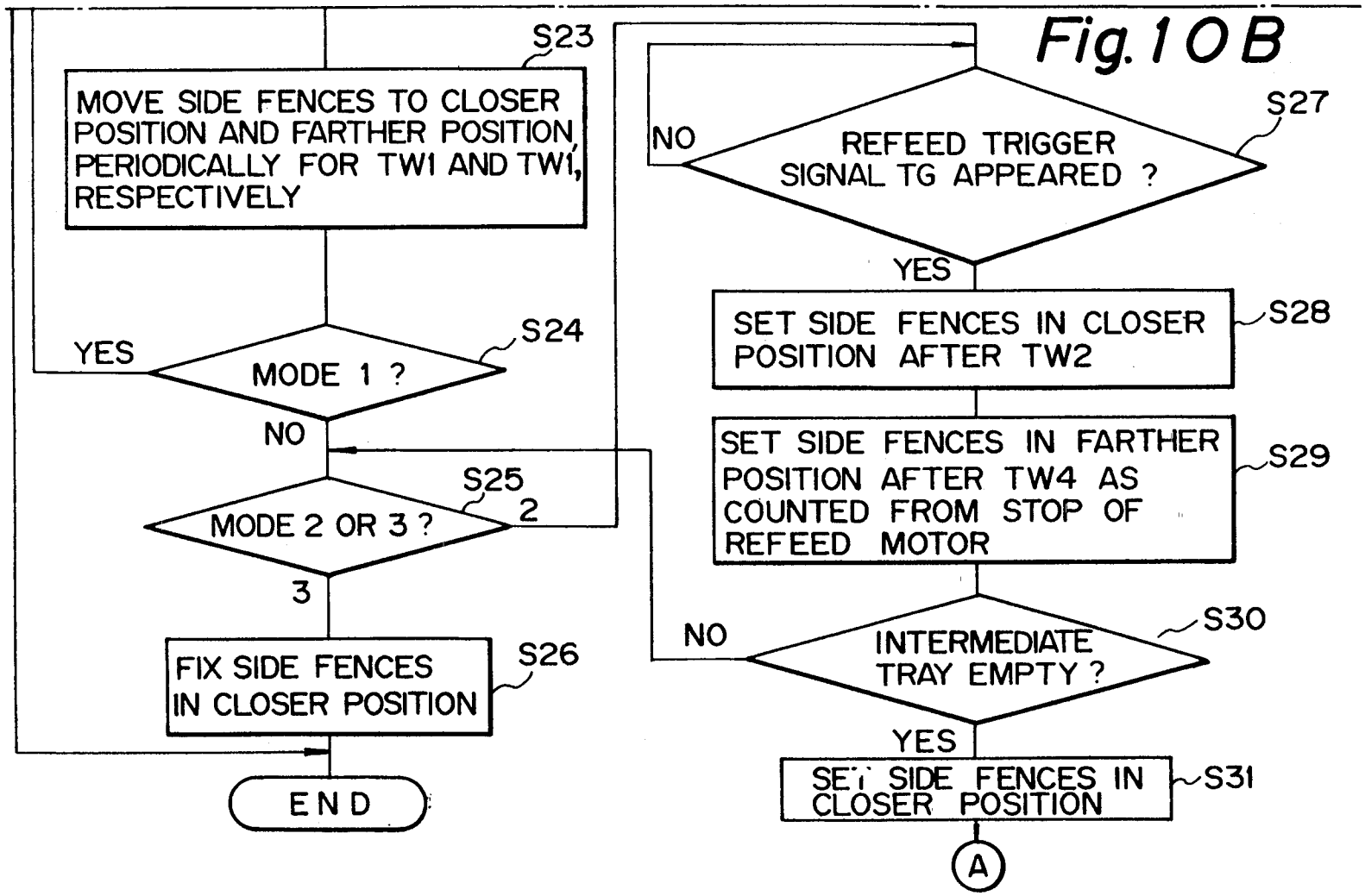
Fig.10B
S23
MOVE SIDE FENCES TO CLOSER POSITION AND FARTHER POSITION, PERIODICALLY FOR TWI AND TWI', RESPECTIVELY
S24
MODE 1 ?
YES
NO
S25
MODE 2 OR 3 ?
2
3
S26
FIX SIDE FENCES IN CLOSER POSITION
END
S27
REFEED TRIGGER SIGNAL TG APPEARED ?
YES
NO
S28
SET SIDE FENCES IN CLOSER POSITION AFTER TW2
S29
SET SIDE FENCES IN FARTHER POSITION AFTER TW4 AS COUNTED FROM STOP OF REFEED MOTOR
S30
INTERMEDIATE TRAY EMPTY ?
YES
NO
S31
SET SIDE FENCES IN CLOSER POSITION
A

CONTROL MEANS FOR GUIDE MEMBERS IN AN INTERMEDIATE TRAY IN A DUPLEX COPIER

This application is a continuation of application Ser. No. 07/552,457, filed on Jul. 16, 1990, now abandoned.

BACKGROUND OF THE INVENTION

1. Field of the Invention

The present invention relates to a control device for a copier of the type loaded with a recyclic document feeder (RDF) and operable in a two-sided copy mode in which paper sheets each carrying an image on one side thereof are sequentially stacked in the copier and refed for transferring images on the other side thereof to produce two-sided copies.

2. Discussion of the Background

Modern copiers are operable with a RDF or an automatic document feeder (ADF) for automatically feeding documents one by one to promote efficient copying operations. The RDF feeds a document from a document tray to a glass platen and, after the document has been copied, returns the document to the tray to allow it to be fed again. In contrast, the ADF usually does not return a document once fed to the glass platen to a document tray. Concerning a single copy of documents, therefore, both the RDF and the ADF are operated in the same manner, i.e., they feed documents one by one for copying them and, on sensing the last document, they terminate the copying operations.

When two or more copies of documents are desired, the ADF and RDF each is operated in a particular way. Assuming that N (equal to or greater than 2) copies are desired, the ADF feeds one of the documents to the glass platen, scans the document N consecutive times, discharges the document, and then scans the next document N consecutive times. In this manner, the copying operation is repeated N times with each of the documents. On the other hand, the RDF feeds one document to the glass platen, scans the document once, returns it to the document tray, and then repeats such a procedure with all of the remaining documents to produce a single copy of the documents at a time. This is repeated N consecutive times to complete N copies of the documents. The RDF is advantageously applicable to a copier having a stapler or similar finisher because it produces a single copy of documents at a time.

The operations of the ADF and RDF are further different from each other when it comes to a copier operable in a two-sided copy mode. Specifically, the ADF products two-sided copies of documents by reproducing the first page N consecutive times while sequentially stacking the resulting one-sided copies on the intermediate tray, refeeding the one-sided copies from the tray to reproduce the second page on the other side thereof, stacking N copies of the third page on the tray, and so forth. On the other hand, the RDF feeds documents one by one while scanning only every two documents, i.e., copies only the odd pages and sequentially stacks then on the intermediate tray. When the documents are fed a second time, paper sheets are fed from a paper feeding device for the odd pages while the one-sided copies existing on the intermediate tray are refed for the even pages. More specifically, in this operation mode, paper sheets are fed from the intermediate tray and the paper tray alternately one at a time.

In the copier with the conventional RDF, a one-sided copy is refed from the intermediate tray for transferring an image to the other side substantially at the same time as a paper sheet fed from the paper feeding device and provided with an image on one side thereof enters the intermediate tray. Generally, the entry of a one-sided copy in and the refeed of a one-sided copy from the intermediate tray differ from one paper size to another with respect to timing. It is likely, therefore, that the entry and the refeed are disturbed unless they are effected in matching relation to the paper size, preventing desired two-sided copies from being achieved.

SUMMARY OF THE INVENTION

It is therefore an object of the present invention to provide a control device which allows a copier of the type operable in a two-sided copy mode to perform two-sided copying operations smoothly.

It is another object of the present invention to provide a generally improved control device for a copier operable in a two-sided copy mode.

In a copier operable in a two-sided copy mode in which paper sheets each carrying an image on one side thereof and having the image fixed therein are sequentially stacked and, at the same time, paper sheets having already been stacked are refed for transferring images to the other side thereof, a control device for the copier of the present invention comprises paper positioning members provided on an intermediate tray, on which one-sided copies each carrying an image on one side thereof may be sequentially stacked, and movable in matching relation to the size of paper sheets for positioning the paper sheets, a paper sensor for determining whether or not paper sheets are present on the intermediate tray, a device for driving the paper positioning members over a predetermined amplitude having a predetermined width and at a predetermined rate, and a controller for controlling the motion of the paper positioning members which are driven by the driving device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
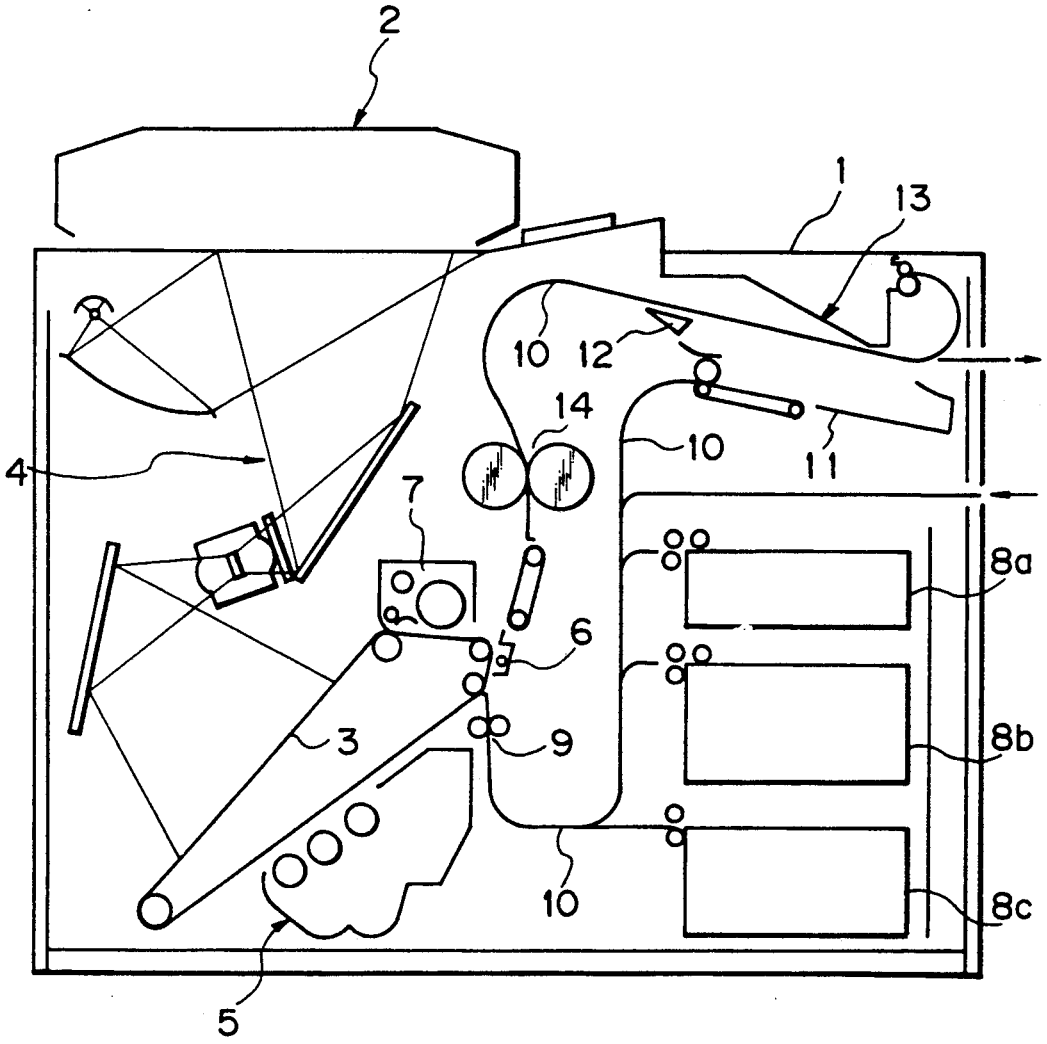
FIG. 1 is a section showing a copier to which a control device embodying the present invention is applied.

Referring to FIG. 1 of the drawings, a copier to which a preferred embodiment of the control device in accordance with the present invention is applicable is shown. As shown, a RDF 2 which per se is known is mounted on the top of a copier body 1. The copier body 1 accommodates therein optics 4 for forming a latent image on a photoconductive element 3. Arranged around the photoconductive element 3 are various process units such as a developing unit 5, an image transferring unit 6, and a cleaning unit 7. A plurality of paper feeding devices 8*a*, 8*b* and 8*c* are each loaded with paper sheets of a particular size. A register roller pair 9 and a guide plate 10 are also disposed in the copier body 1. An intermediate tray 11, a selector pawl 12 and a copy tray 13 are located above the paper feeding device 8*a*. A fixing unit 14 is interposed between the copy tray 13 and the image transferring unit 6.

In operation, a paper sheet is fed from any one of the paper feeding devices 8*a* and 8*c* to the image transferring unit 6 which then transfers a toner image to the paper sheet. The fixing unit 14 fixes the toner image on the paper sheet by applying heat thereto. Thereafter, the paper sheet or copy is driven out to the copy tray 13. In a two-sided copy mode, the selector pawl 12 is so positioned so as to steer the paper sheet or one-sided copy to the intermediate tray 11. Then, the one-sided copy is refed from the intermediate tray 11. After another toner image has been transferred to the other side of the one-sided copy, the resulting two-sided copy is discharged to the copy tray 13 by way of the fixing unit 14. A stapler or similar finisher may be associated with the copier body 1.

Figure 8:
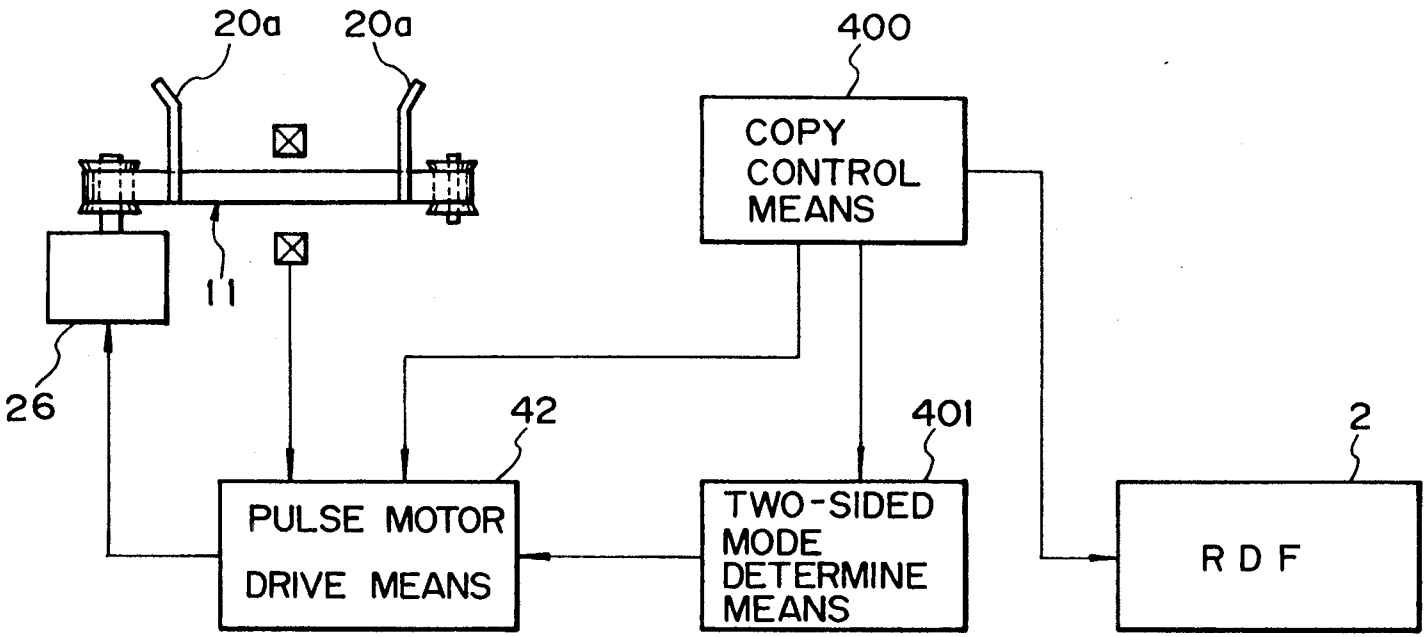
FIG. 8 is a block diagram schematically showing a preferred embodiment of the control device in accordance with the present invention.

FIG. 8 shows the control device embodying the present invention schematically. The control device has copy control means 400 which delivers control signals to pulse motor drive means 42, two-sided copy mode determining means 401, and the RDF 2. The output of the two-sided copy mode determining means 401 is connected to the pulse motor driver means 42 whose output is in turn connected to a pulse motor 26. The intermediate tray 11 has opposite side fences 20*a* which are driven by the pulse motor 26, as will be described in detail later.

Figure 2:
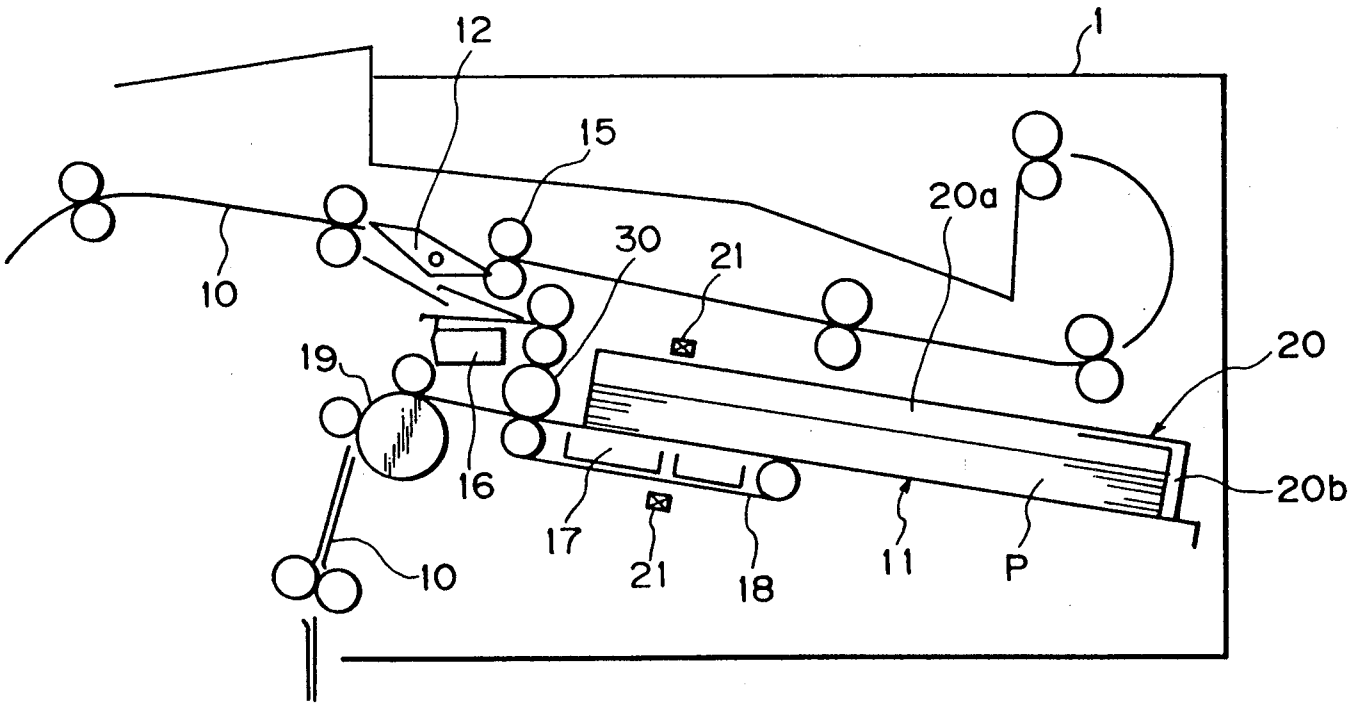
FIG. 2 is an enlarged section showing an intermediate tray and its associated members included in the copier of FIG. 1.

The intermediate tray 11 is constructed as shown in FIG. 2 specifically. Paper sheets P each carrying a toner image on one side thereof are sequentially stacked on the tray 11 by a discharge roller pair 15. An air knife 16 blows air into the tray 11 to maintain the stack of paper sheets P in a floating state. The air knife 16 is so configured as to maintain the paper sheets P afloat above the tray 11 until the latter reaches a predetermined number. Sucking means 17 is turned on at a predetermined timing to suck the lowermost paper sheet P, while an endless belt 18 transports it toward a grip roller 19. The grip roller 19 refeeds the lowermost paper sheet P so that a toner image may be transferred to the other side of the paper sheet P. Since the air knife 16 causes the paper sheets P to float and thereby reduces the coefficient of friction thereof, the lowermost paper sheet P sucked by the sucking means 17 is spaced apart from the overlying or second paper sheet P. The air from the air knife 16 enters the gap between the lowermost and second paper sheets P to separate them from each other.

The intermediate tray 11 has thereinside paper positioning means 20 which is made up of the pair of side fences 20*a* and a back fence 20*b*. The side fences 20*a* and back fence 20*b* each are movable to adapt themselves to a particular paper size. Sensing means 21 is constituted by a light emitting element and a light-sensitive element which face each other with the intermediary of the tray 11. The sensing means 21 senses paper sheets P which may be stacked on the tray 11. The side fences 20*a* serve two different functions, i.e., a function of positioning the paper sheets P which sequentially enter the tray 11 and a function of guiding them at the time of refeed. Specifically, when the paper sheets P each carrying a toner image on one side thereof are sequentially driven into the tray 11, the side fences 20*a* are moved toward and away from each other within a predetermined width in order to position the paper sheets P. At the time of refeed, the side fences 20*a* are each moved to a predetermined position matching the paper size so as to regulate the position of the paper sheets. On the other hand, the back fence 20*b* is movable back and forth in the intended direction of paper feed in association with the paper size and is stopped at a predetermined position. Specifically, the back fence 20*b* is movable such that a predetermined distance is defined between the leading edge of the paper stack P and a separating roller 30 with no regard to the paper size. Pulse motors, not shown, each serving as individually controlled drive means, as will be described, drive the side fences 20*a* and back fence 20*b* under the control of a CPU (Central Processing Unit), not shown. As the CPU feeds particular numbers of pulses and direction signals to the pulse motors, the side fences 20*a* and back fence 20*b* are brought to particular positions and the former is moved toward and way from each other with a predetermined amplitude and at a predetermined rate.

Figure 3:
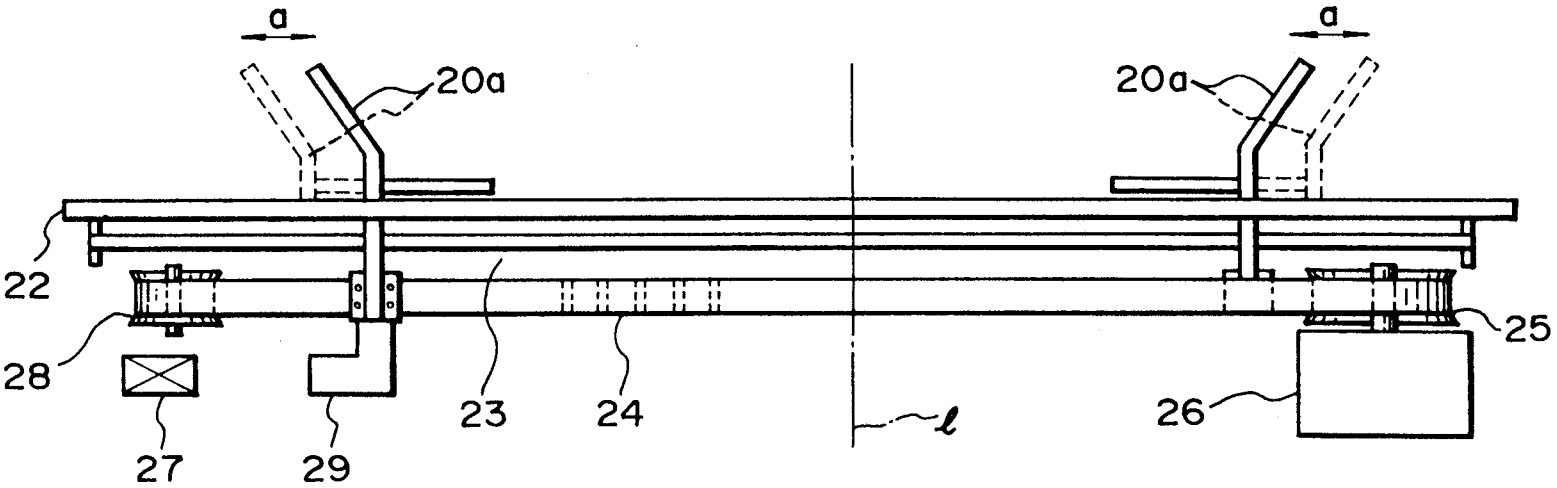
FIG. 3 is a side elevation of means for driving side fences which form a part of paper positioning means.

As shown in FIG. 3, arranged around the side fences 20*a* are a bottom plate 22, a side fence rail 23, a timing belt 24 partly affixed to the side fences 20*a*, a first pulley 25, the pulse motor 26, a photointerrupter 27, a second pulley 28, and a screening plate 29. As the pulse motor 26 is rotated, the first pulley 25 and timing belt 24 move the side fences 20*a*. In this instance, the side fences 20*a* facing each other are constantly located at the same distance as each other as measured from the center l. The photointerrupter 27 is used to set up the home position of the side fences 20*a*, i.e., to sense the arrival of the screening plate 29 due to the increasing distance between the side fences 20*a*.

As an image transferring operation begins, the pulse motor 26 is rotated in a direction for moving the side fences 20*a* away from each other. When the photointerrupter 27 senses the screening plate 29, such a movement of the side fences 20*a* is stopped. This is the home position of the side fences 20*a*. The side fences 20*a* are brought to the home position once with no regard to the size of the paper sheets P. Subsequently, the pulse motor 26 is reversed to move the side fences 20*a* toward each other in matching relation to the size of the paper sheets P which will enter the intermediate tray 11. The side fences 20*a* are brought to a stop at a position matching the paper size without fail, because a particular number of pulses is assigned to each paper size beforehand. The procedure described so far is completed before the paper sheets P reach the intermediate tray 11 after the start of the image transferring operation. The side fences 20*a* position the paper sheets P entering the tray 11 one after another in the direction perpendicular to the intended direction of paper feed, while repetitively moving toward and away from each other at a predetermining timing. In an ADF mode, the refeed of paper sheets P from the tray 11 begins after all of them have been stacked on the tray 11, so that the side fences 20*a* are operated, as will be outlined hereinafter.

On the entry of a paper sheet P in the intermediate tray 11, the side fences 20*a* are moved away from each other by the pulse motor 26 by a small distance α each and then toward each other by the same distance α immediately before the paper sheet P falls onto the bottom plate 22. In a continuous paper feed mode, such a reciprocating or jogging motion of the side fences 20*a* is repeated until all the paper sheets P have been stacked on the tray 11. When all the paper sheets P have been stacked, the side fences 20*a* are moved toward each other to a position for restricting the paper sheets P. Concerning the distance α, 10 to 15 millimeters suffices in practice. When the paper sheets P are refed from the tray 11, the lowermost one being first, the side fences 20*a* are not moved and serve as a guide for freezing the paper sheets P from skews.

As stated above, in the ADF and two-sided copy mode, it is only after all the one-sided paper sheets have been stacked on the intermediate tray 11 that the refeed begins and, therefore, the movement of the side fences 20*a* is simple. It is important that the side fences 20*a* be held in a half during refeed, otherwise the paper sheets would be refed askew to cause incomplete lateral register, jams, etc.

The side fences 20*a* will be operated in the RDF and two-sided copy mode, as follows.

In the RDF mode, the entry of a paper sheet in and the refeed of a paper sheet from the intermediate tray 11 occur alternately at predetermined timings. This will be described specifically with reference to FIG. 5 in which six documents are recyclically fed to produce three sets of reproductions or three copies by way of example.

Figure 5:
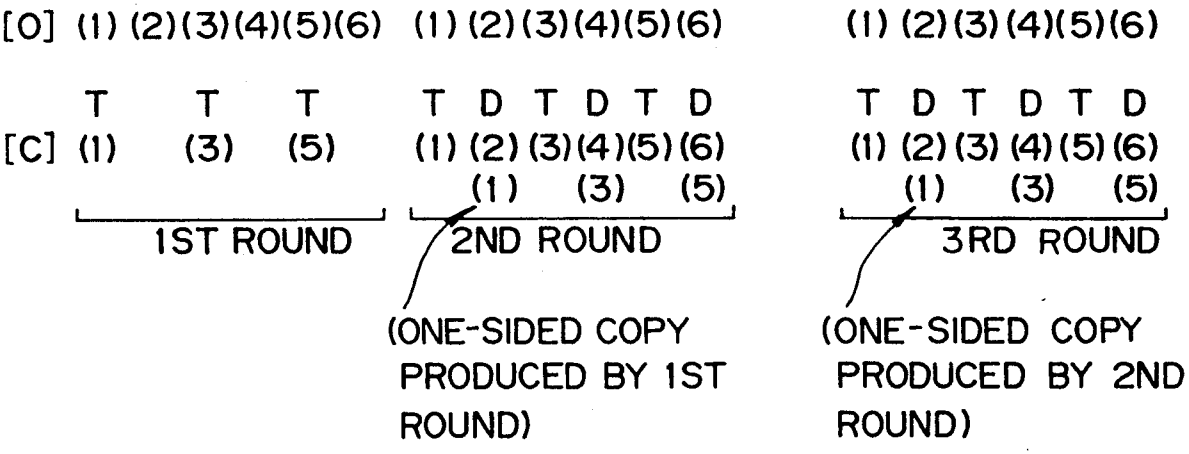
FIG. 5 is a timing chart indicative of the entry of paper sheets and the refeed of paper sheets.

In FIG. 5, the upper row [O] is representative of the movement of the documents, e.g., (1) shows that the first page is fed to a glass platen. The lower row [C] represents that a copying operation is effected, i.e., (1) shows that the first page is reproduced. The letters T and D represent that a paper sheet for reproduction is fed from any one of the paper feeding devices 8*a* to 8*c* and that a one-sided paper sheet is refed from the intermediate tray 11, respectively. A paper sheet fed from the paper feeding device 8 is routed to the intermediate tray after a toner image has been fixed thereon, while a paper sheet refed from the intermediate tray 11 is driven out of the copier after a toner image has been transferred to the other side thereof. As FIG. 5 indicates, the entry of a paper sheet in and the refeed of a paper sheet from the tray 11 occur substantially alternately during the second and third rounds of the documents.

The point in the above-stated mode operation is the movement of the side fences 20*a*. During the first round of the documents, one-sided paper sheets are simply stacked on the intermediate tray 11 and, hence, the side fences 20*a* should only repeat their jogging motion at predetermined intervals. Also, during the fourth round, the side fences 20*a* should only be held in their closer position because one-sided paper sheets are simply refed. However, when it comes to the second and third rounds, the side fences 20*a* have to perform the jogging motion when a paper sheet enters the tray 11 or have to be fixed in their closer position when a paper sheet is refed from the tray 11. Especially, in the event of refeed, the side fences 20*a* have to be fixed in place at least until the belt 18 has been moved to transport a paper sheet to the grip roller 19. The problem is that the timing at which a paper sheet enters the tray 11 and the timing at which a paper sheet is refed from the tray 11 differ from one paper size to another, resulting in complicated control over the jogging motion. The control in accordance with the illustrative embodiment maintains the side fences 20*a* in their closer position for a predetermined period of time in the event of refeed.

Figure 6:
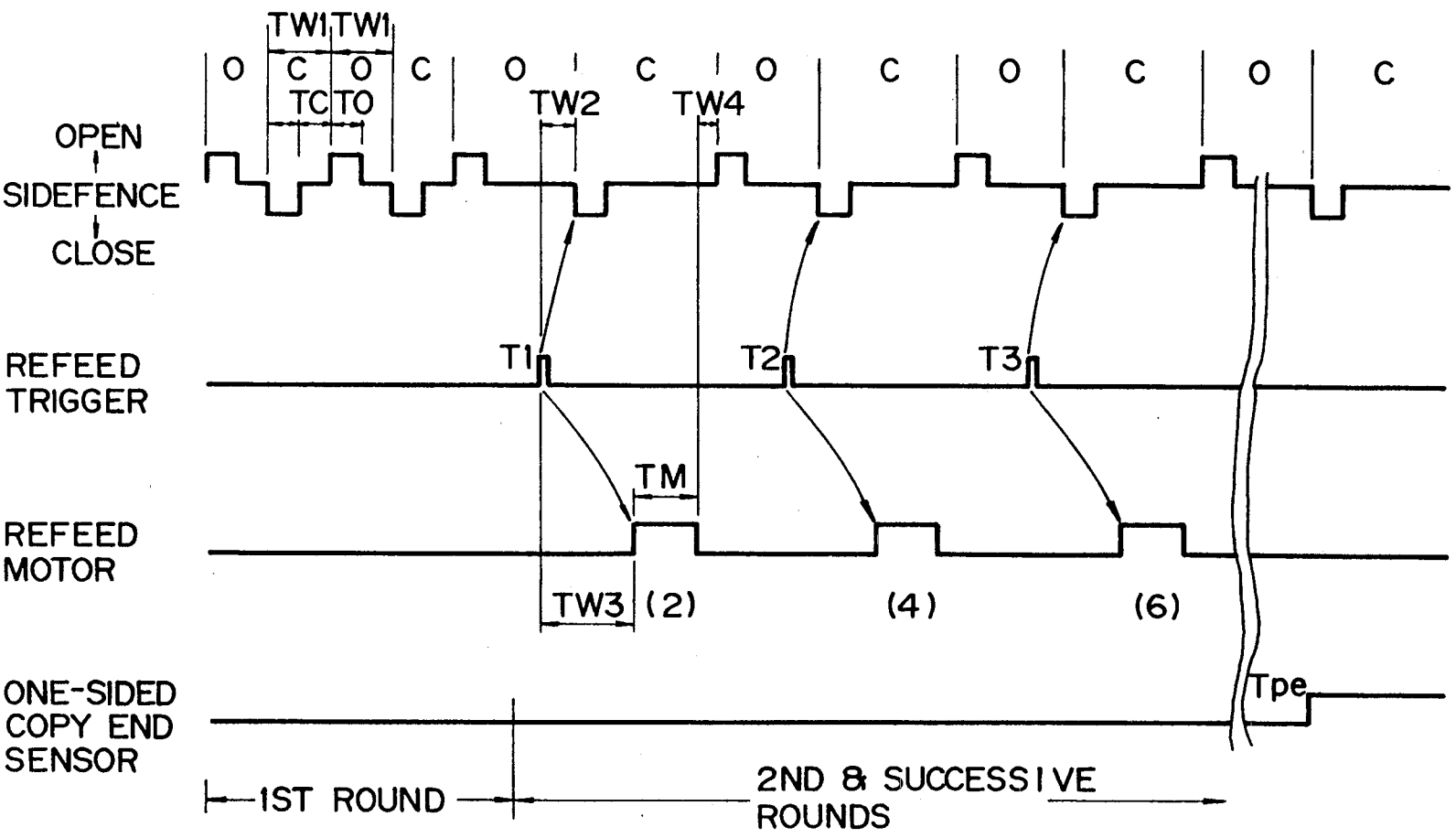
FIG. 6 is a timing chart representative of the operation of control means.

Specifically, as shown in FIG. 6, the side fences 20*a* each move the distance α in a predetermined period of time TO (0.1 second) and return to the closer position in a period of time TC (0.1 second). During the first round of the documents, the above motion is repeated at predetermined intervals because one-sided paper copies of odd pages are simply stacked on the intermediate tray 11. In the figure, the letter O shows that the side fences 20*a* are moved to their farther position and this condition continues over a period of time TW'1 which is 0.5 second. The letter C shows that the side fences 20*a* are moved to their closer position and this condition continues over a period of time TW1 which is 1.0 second. As shown, while paper sheets ar simply stacked one after another on the tray 11, the side fences 20*a* are operated periodically, i.e., they are held in the closer position for about 1 second, in the farther position for about 0.5 second, and again in the closer position for about 1 second.

When a first one of a group of paper sheets to be sequentially stacked on the tray 11 arrives, the side fences 20*a* have to be held in the closer position without fail. Further, when the tray 11 is emptied, the side fences 20*a* are immediately returned to the closer position (Tpe, FIG. 6). It is to be noted that the specific periods of time of 0.1 second (TO), 0.1 second (TC), 1 second (TW1) and 0.5 second (TW'1) were selected for experiment purposes. When the second round begins, a trigger signal TG appears for refeeding the one-sided copies to reproduce the even pages of the documents. The trigger signal TG is generated within the control system for refeeding one paper sheet and is not an externally derived signal. After the trigger signal TG has appeared at a time T1, the side fences 20*a* are moved toward each other on the lapse of a predetermined period of time TW2 and fixed in such a position to prepare for the refeed. On the lapse of a period of time TW3 as counted from T1, a refeed motor, not shown, is rotated for a period of time TM to drive the belt 18 until one paper sheet has been refed from the tray 11 to the grip roller 19. Once the paper sheet is gripped by the roller 19, there is no fear of skew even when the side fences 20*a* are moved away from each other. Hence, on the lapse of a period of time TW4, the side fences 20*a* are moved away from each other to receive the next paper sheet to enter the tray 11. In response to the second and successive trigger signals TG appearing at T2, T3 and so forth, the above operation is repeated. As all the paper sheets have been refed from the tray 11 at the end of the fourth round, the paper end sensor 21 responsive to the absence of paper sheets on the tray 11 produces an output for returning the side fences 20*a* to the closer position.

As stated above, in the illustrative embodiment, the side fences 20*a* are moved toward and away from each other in synchronism with the refeed of one-sided copies while such copies enter and leave the intermediate tray 11 alternately. In the event of refeed, the side fences 20*a* are held in the closer position without exception in order to restrict paper sheets while, in the other instance, they are maintained in the farther position to receive a paper sheet to enter the tray 11 for thereby neatly positioning the paper sheets sequentially reaching the tray 11.

The back fence 20*b* is operated and controlled, as follows.

Figure 4:
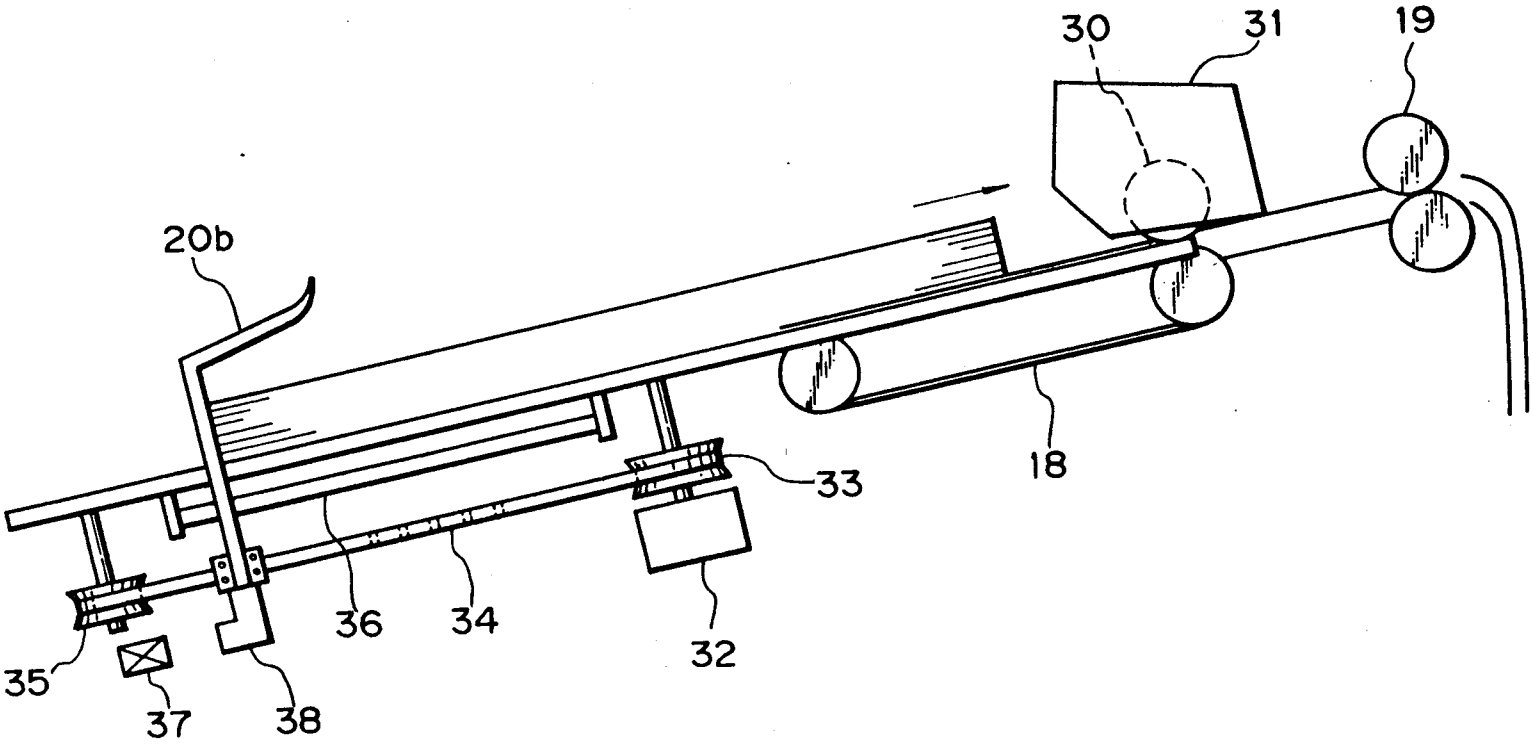
FIG. 4 is a side elevation of means for driving a back fence which forms the other part of the paper positioning means.

As shown in FIG. 4, arranged around the back fence 20*b* are the endless belt 18 for refeed, the grip roller pair 19, a separating roller 30, an air chamber 31 for the air knife, a pulse motor 32 for moving the back fence 20*b*, a third pulley 33, a timing belt 34 affixed to a part of the back fence 20*b*, a fourth pulley 35, a guide rail 36 for the back fence 20*b*, a photointerrupter 37 for the back fence 20*b*, and a screening plate 38 affixed to a part of the back fence 20*b*. On the start of an image transferring operation, the pulse motor 32 is rotated in a direction for retracting the back fence 20*b* with respect to the intended direction of paper feed. The pulse motor 32 is deenergized when the photointerrupter 37 senses the screening plate, i.e., when the back fence 20*b* reachs its home position. Thereafter, the pulse motor 32 is treversed to move the back fence 20*b* forward. Since a particular number of pulses are fed to the pulse motor 32 depending on the paper size, the back fence 20*b* is moved to and stopped at a particular position matching the paper size. Such a movement of the back fence 20*b* maintains the distance between the leading edge of the paper stack P and the separating roller 30 constant with no regard to the paper size. This procedure associated with the back fence 20*b* is completed before a paper sheet P enters the intermediate tray 11 after the start of the image transferring operation, as has been the case with the side fences 20*a*. The difference is that the back fence 20*b* does not move either in the stacking operations or in the refeeding operations.

Figures 9, 9A, 9B:
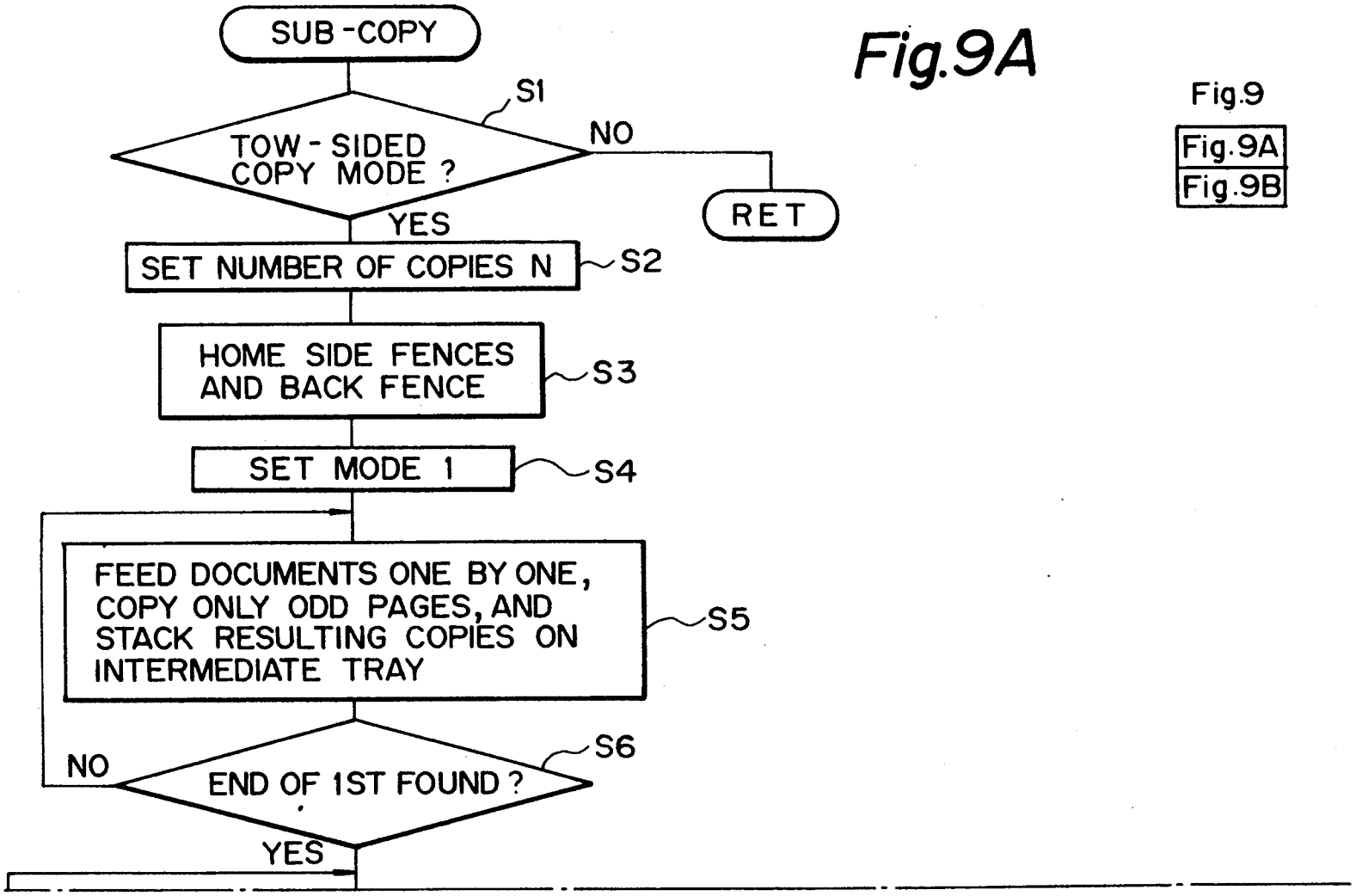
FIG. 9 is a flowchart demonstrating a specific operation of the illustrative embodiment.
Figure 9B:
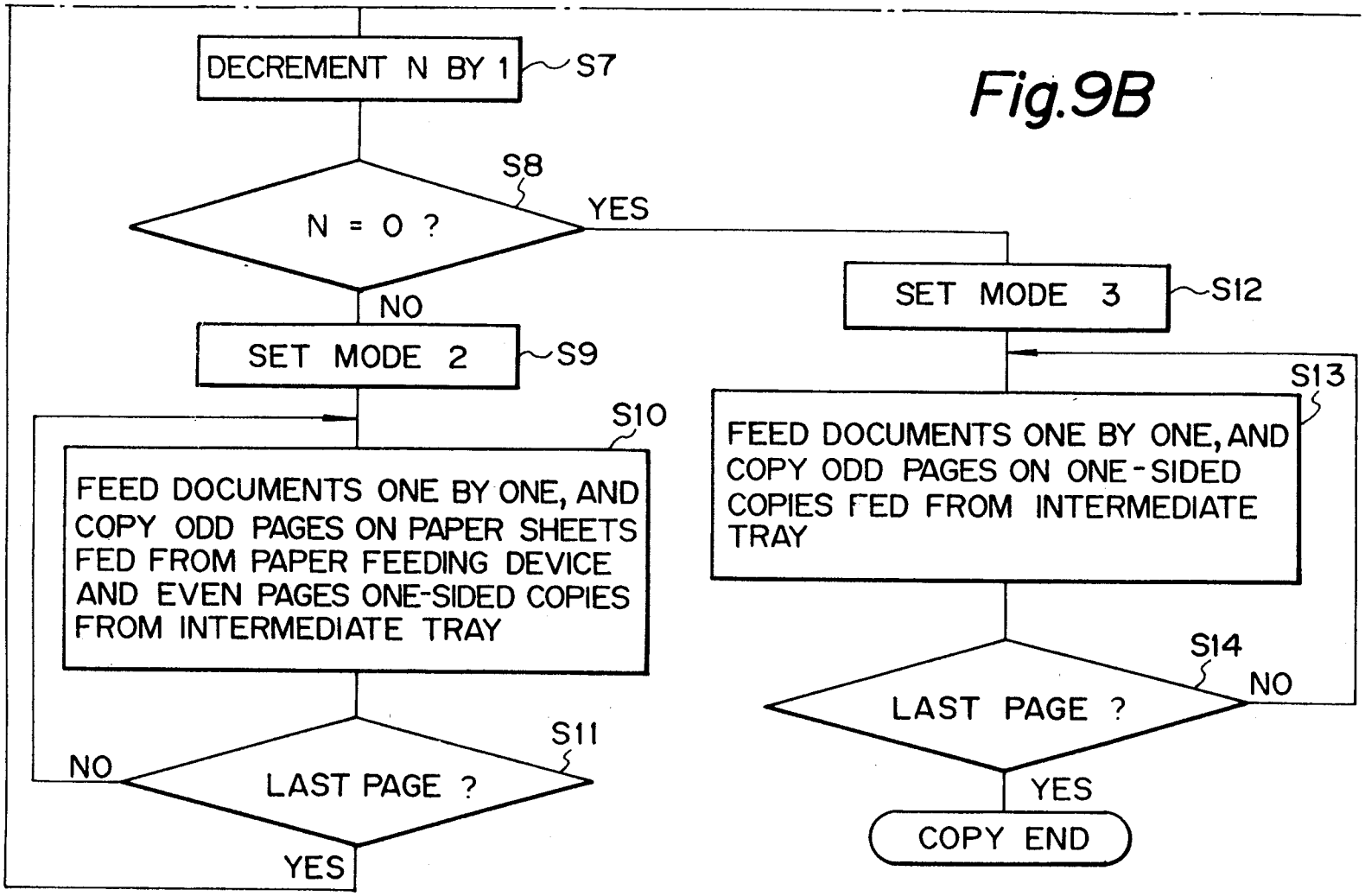

A reference will be made to FIG. 9 for describing the copying operation particular to the illustrative embodiment.

In a step S1, whether or not a two-sided copy mode is selected is determined. If the answer of the step S1 is YES, a desired number N of copies of documents is set (step S2). Then, the side fences 20*a* and back fence 20*b* are brought to their home positions (step S3). Subsequently, Mode 1 is set for the first round of copying operations (step S4), and the documents are fed one one by to reproduce only the odd pages thereof while the resulting copies are sequentially stacked on the intermediate tray 11 (step S5). Whether or not the first round of copying operations has been completed is determined (step S6). If the answer of the step S6 is NO, the step S5 is continued; if it is YES, a step S7 is executed for decrementing the set number N by one. This is followed by determining whether or not the set number N is zero, i.e., whether or not the round of interest is the last round (step S8).

If the answer of the step S8 is NO, Mode 2 is set (step S9). In this mode, the documents are fed one by one to reproduce the odd pages on paper sheets fed from the paper feeding device 8 and the even pages on the paper sheets refed from the intermediate tray 11. Then, whether or not the page of interest is the last page is determined (step S11). If the answer of the step S11 is NO, the step S10 is continued; if otherwise, the program returns to the step S7. Such a procedure is repeated until N reaches zero as determined in the step S8. Then, Mode 3 is set (step S12) and the documents are fed one by one to reproduce only the even pages on the paper sheets refed from the tray 11 (step S13). When the last page of the documents is reproduced as determined in a step S14, the copying operation ends.

Figures 10, 10A:
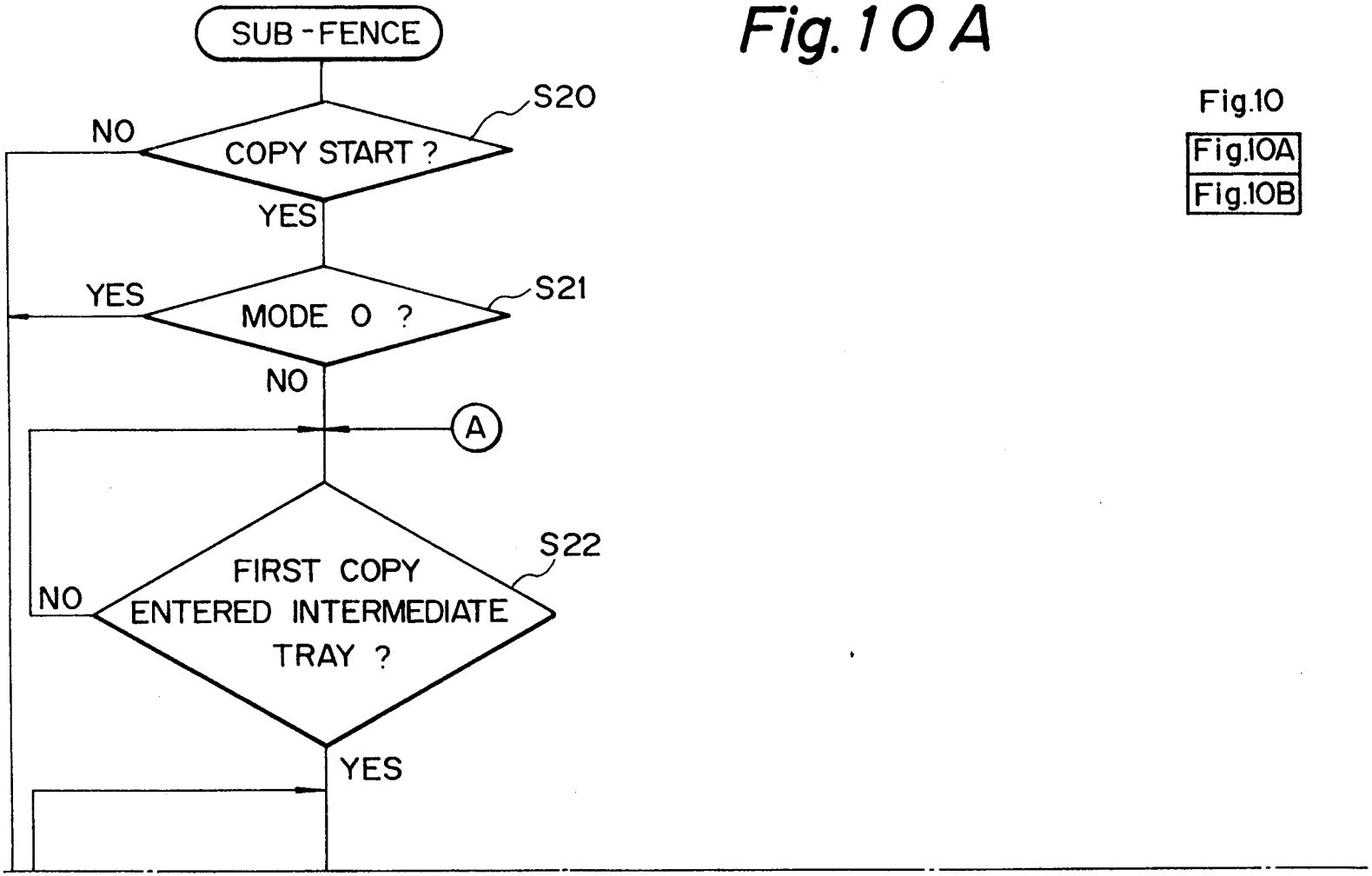
FIG. 10 is a flowchart showing a specific operation of the side fences of the illustrative embodiment.

The movement of the side fences 20*a* will be described will reference to FIG. 10. The procedure begins with a step S20 for determining whether or not a copying operation has begun. If the answer of the step S20 is YES, whether or not Mode 0 has been set is determined (step S21). If the answer of the step S21 is NO, whether or not the first one-sided copy has enter the intermediate tray 11 is determined (step S22). If the answer of the step S22 is YES, the side fences 20*a* are moved toward and away from each other periodically for the periods of time TW'1 and TW1, respectively. Subsequently, whether or not Mode 1 has been set is determined (step S24). The step S23 is repeated until the answer of the step S24 turns to NO. On the turn of the answer of the step S24 to NO, whether Mode 2 or Mode 3 has been set is determined (step S25). If Mode 3 has been set as determined in the step S25, the program advances to a step S26 for fixing the side fences 20*a* in their closer position. If Mode 2 has been set, whether or not the refeed trigger signal TG has appeared is determined (step S27). If the answer of the step S27 is YES, the side fences 20*a* are brought to the closer position on the lapse of a period of time TW2 (step S28). This is followed by a step S29 for moving the side fences 20*a* to the farther position on the lapse of a period of time TW4 as counted from the time when the refeed motor has been deenergized. Subsequently, whether or not the intermediate tray 11 is empty is determined (step S30). If the answer of the step S30 is YES, the side fences 20*a* are moved to the closer position (step S31). The program returns from the step S31 to the step S22. If the answer of the step S30 is NO, the program returns to the step S25.

Figure 7:
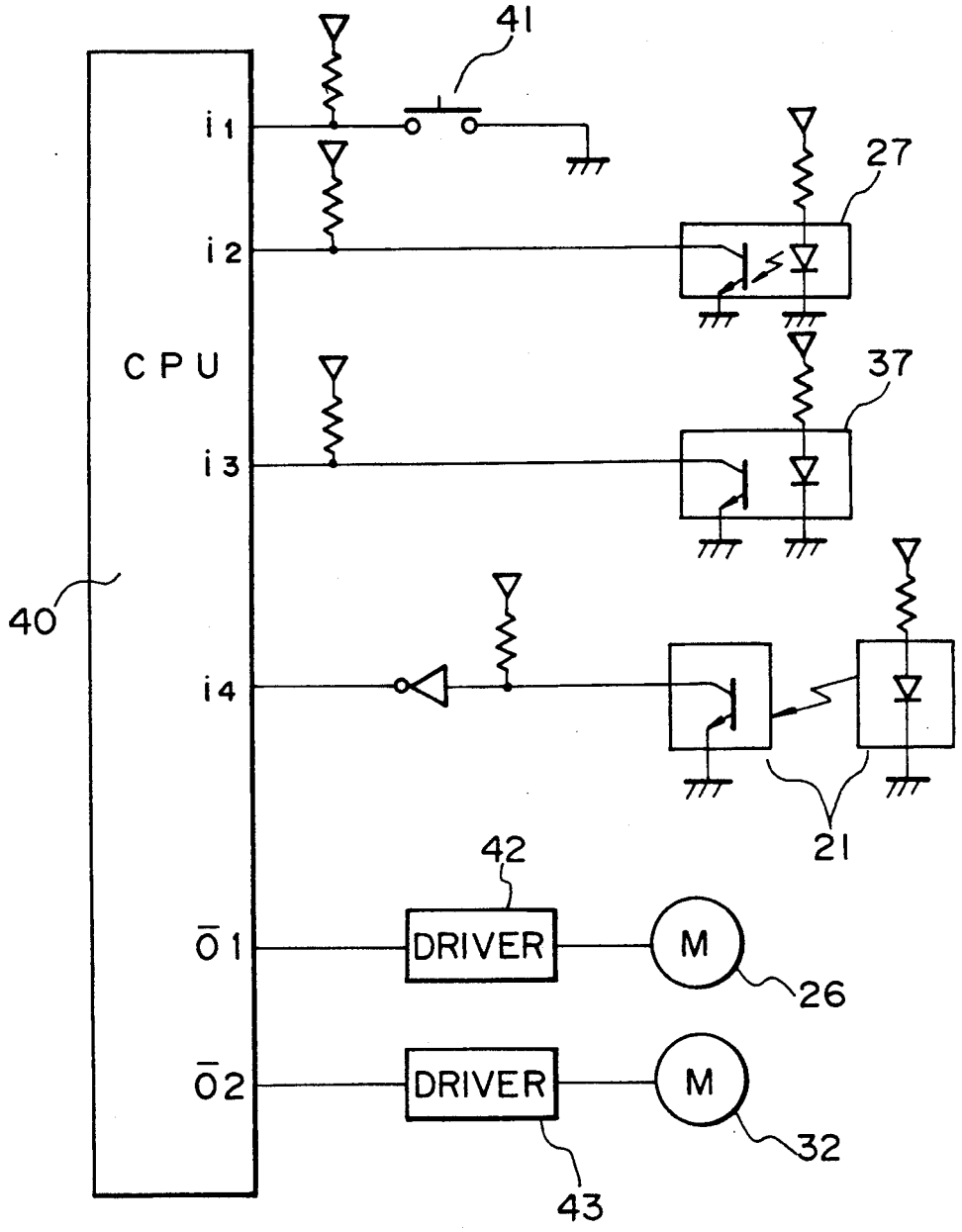
FIG. 7 is a schematic block diagram showing an essential part of the control means.

FIG. 7 is a schematic block diagram showing a control system for executing the above-described control. As shown, the system has a CPU 40 loaded with programs for controlling all the loads, a print key 41 for commanding the starting of a copying operation, and drivers 42 and 43 for driving the side fence drive motors 26 and 32, respectively. Each of the motors 36 and 32 is reversibly rotated by a predetermined amount in response to a signal fed thereto from the CPU 40. By such a control system, the various operations described above are executed to allow two-sided copies to be produced smoothly with no regard to the paper size and with one-sided copies and paper sheets being prevented from conflicting with each other.

In summary, in accordance with the present invention, side fences of an intermediate tray are moved toward and away from each other in a two-sided copy mode of a copier which is loaded with a RDF. Hence, even when paper sheets are driven into and out of the intermediate tray alternately, the paper sheets can be accurately controlled in position on the intermediate tray with no regard to the paper size and, hence, the paper feeding operations are fed from disturbance.

Various modifications will become possible for those skilled in the art after receiving the teaching of the present disclosure without departing from the scope thereof.

What is claimed is:

1. A control device for a copier loaded with a recyclic document feeder and operable in a two-sided copy mode in which present one-sided copy paper sheets each carrying an image on one side thereof and having said image fixed therein are sequentially stacked on an intermediate tray and, at the same time, preceding one-side copy paper sheets each carrying a fixed image on one side thereof and having already been stacked on said intermediate tray are sequentially refed from only the bottommost thereof one by one for transferring images to the other side thereof, said control device comprising:

paper positioning means provided on said intermediate tray and movable in matching relation to a size of the one-sided copy paper sheets for positioning said one-sided copy paper sheets;

refeeding means for sequentially refeeding only the bottommost of said preceding one-sided copy paper sheets one-by one from said intermediate tray, for forming two-sided copy paper sheets, simultaneously with said present one-sided copy paper sheets being stacked on said intermediate tray;

driving means for driving said paper positioning means over a predetermined amplitude having a predetermined width and at a predetermined rate during the simultaneous stacking of said present one-sided copy paper sheets and refeeding of said preceding one-sided copy paper sheets; and control means for controlling a motion of said paper positioning means which is driven by said driving means.

2. A control device as claimed in claim 1, wherein said paper positioning means comprises a pair of side fences movable toward and away from each other in a direction perpendicular to an intended direction of paper transport and over a predetermined width in matching relation to a size of the one-sided copy paper sheets, and a back fence movable back and forth in said intended direction of paper transport in matching relation to a size of the one-sided copy paper sheets.

3. A control device as claimed in claim 2, wherein said control means controls said driving means such that, when the preceding one-sided copy paper sheets are to be refed, said side fences are moved toward each other in synchronism with refeed timings.

4. A control device as claimed in claim 2, wherein said side fences have a function of positioning the present one-sided copy paper sheets which sequentially enter the tray and a function of guiding the preceding one-sided copy paper sheets to be refed.

5. A control device as claimed in claim 2, wherein said side fences are moved between their position for positioning the present one-sided copy paper sheets and their farther position for receiving the preceding one-sided copy paper sheets which enter the tray.

6. A control device as claimed in claim 2, wherein said side fences are held in their closer position to restrict the preceding one-sided copy paper sheets at the time of refeed.

7. A control device as claimed in claim 2, wherein said side fences are not moved and serve as a guide for freeing the preceding one-sided copy paper sheets from skews.

8. A control device for a copier loaded with a recyclic document feeder and operable in a two-sided copy mode in which present one-sided copy paper sheets each carrying an image on one side thereof and having said image fixed therein are sequentially stacked on an intermediate tray and, at the same time, preceding one-sided copy paper sheets each carrying a fixed image on one side thereof and having already been stacked on said intermediate tray are sequentially refed from only the bottommost thereof for transferring images to the other side thereof, said control device comprising:

a pair of side fences provided on said intermediate tray and movable toward and away from each other in a direction perpendicular to an intended direction of paper transport and over a predetermined amplitude having a predetermined width and at a predetermined rate in matching relation to a size of the one-sided copy paper sheets for positioning said one-side copy paper sheets;

refeeding means for sequentially refeeding only the bottommost of said preceeding one-sided copy paper sheets one by one from said intermediate tray, for forming two-sided copy paper sheets, simultaneously with said present one-sided copy paper sheets being stacked on said intermediate tray;

driving means for driving said side fences over the predetermined amplitude having the predetermined width and at the predetermined rate during the simultaneous stacking of said present one-sided copy paper sheets and refeeding of said preceding one-sided copy paper sheets such that said side fences are moved between their closer position for positioning the preceding one-sided copy paper sheets and their farther position for receiving the present one-sided copy paper sheets which enter the tray; and control means for controlling a motion of said side fences which are driven by said driving means such that when the preceding one-sided copy paper sheets are to be refed, said side fences are moved toward each other in synchronism with refeed timings and held in their closer position for a predetermined period of time.

9. A control device as claimed in claim 8, further comprising a back fence movable back and forth in said intended direction of paper transport in matching relation to a size of the one-sided copy paper sheets.

10. A control device as claimed in claim 8, wherein said side fences have a function of positioning the present one-side copy paper sheets which sequentially enter the tray and a function of guiding the preceding one-sided copy paper sheets to be refed.

11. A control device as claimed in claim 8, wherein said side fences are not moved and serve as a guide for freeing the preceding one-sided copy paper sheets for skews.

12. A control device as claimed in claim 1, further comprising paper sensing means for determining whether or not one-sided copy paper sheets are present on the intermediate tray.

13. A control device as claimed in claim 8, further comprising paper sensing means for determining whether or not one-sided copy paper sheets are present on the intermediate tray.

* * * * *